US010808935B2

(12) United States Patent
Staufer et al.

(10) Patent No.: US 10,808,935 B2
(45) Date of Patent: Oct. 20, 2020

(54) FUEL SPRAY NOZZLE COMPRISING AXIALLY PROJECTING AIR GUIDING ELEMENT FOR A COMBUSTION CHAMBER OF A GAS TURBINE ENGINE

(71) Applicant: Rolls-Royce Deutschland Ltd & Co KG, Blankenfelde-Mahlow (DE)

(72) Inventors: Max Staufer, Berlin (DE); Miklos Gerendas, Am Mellensee (DE); Ruud Eggels, Berlin (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 128 days.

(21) Appl. No.: 16/141,287

(22) Filed: Sep. 25, 2018

(65) Prior Publication Data

US 2019/0093897 A1 Mar. 28, 2019

(30) Foreign Application Priority Data

Sep. 28, 2017 (DE) ..... 10 2017 217 329

(51) Int. Cl.
*F23R 3/28* (2006.01)
*F23D 11/10* (2006.01)
*F23R 3/14* (2006.01)

(52) U.S. Cl.
CPC ..... *F23R 3/286* (2013.01); *F23D 11/107* (2013.01); *F23R 3/14* (2013.01); *F23R 3/28* (2013.01); *F23D 2900/11101* (2013.01)

(58) Field of Classification Search
CPC ..... F23R 3/14; F23R 3/286; F23R 3/28
See application file for complete search history.

(56) References Cited

U.S. PATENT DOCUMENTS 5,737,921 A 4/1998 Jones et al.
9,423,137 B2 8/2016 Nickolaus
(Continued)

FOREIGN PATENT DOCUMENTS

EP 1069377 A2 1/2001
EP 1975514 A2 10/2008
(Continued)

OTHER PUBLICATIONS

European Search Report dated Feb. 1, 2019 for counterpart European Patent Application No. 18196253.1.
(Continued)

*Primary Examiner* — William H Rodriguez
(74) *Attorney, Agent, or Firm* — Shuttleworth & Ingersoll, PLC; Timothy J. Klima

(57) ABSTRACT

A combustion chamber assembly group includes a nozzle providing a fuel-air mixture at a nozzle exit opening. An end of a fuel guiding channel is bordered at the nozzle exit opening by a flow-off edge located radially outside, and an air guiding element of an air guiding channel of the nozzle located radially outside projects with respect to this flow-off edge in the axial direction with respect to a nozzle longitudinal axis such that: a reference angle present between the nozzle longitudinal axis and a straight boundary line extending through a point at the flow-off edge and tangentially to the axially projecting air guiding element, and/or a reference angle present between the nozzle longitudinal axis and a straight boundary line extending through a point at the flow-off edge and a point of the air guiding element that projects maximally beyond the flow-off edge in the axial direction is ≤50°.

8 Claims, 10 Drawing Sheets

(56) References Cited

U.S. PATENT DOCUMENTS

| | | | | |
|---|---|---|---|---|
| 2007/0137207 | A1 | 6/2007 | Mancini et al. | |
| 2009/0044538 | A1 | 2/2009 | Pelletier et al. | |
| 2010/0206343 | A1 | 8/2010 | Sakamoto et al. | |
| 2010/0307161 | A1* | 12/2010 | Thomson | F23D 11/107 60/748 |
| 2012/0304649 | A1* | 12/2012 | Matsuyama | F23R 3/14 60/737 |
| 2013/0327849 | A1* | 12/2013 | Matsuyama | F02M 23/12 239/406 |
| 2014/0360202 | A1 | 12/2014 | Toon et al. | |
| 2015/0052899 | A1* | 2/2015 | Toon | F23R 3/14 60/746 |
| 2015/0159874 | A1* | 6/2015 | Toon | F23R 3/283 60/737 |
| 2016/0265778 | A1* | 9/2016 | Patel | F23R 3/286 |
| 2016/0265780 | A1* | 9/2016 | Patel | F23R 3/283 |
| 2016/0281991 | A1* | 9/2016 | Rullaud | F23R 3/286 |
| 2016/0363320 | A1* | 12/2016 | Benjamin | F02C 7/22 |
| 2016/0363321 | A1 | 12/2016 | Benjamin et al. | |
| 2017/0146243 | A1* | 5/2017 | Siders | F02C 3/04 |
| 2019/0309951 | A1* | 10/2019 | Joshi | F23R 3/286 |

FOREIGN PATENT DOCUMENTS

| | | | |
|---|---|---|---|
| EP | 2840316 | A1 | 2/2015 |
| JP | 200930609 | A | 8/2010 |

OTHER PUBLICATIONS

German Search Report dated Jun. 6, 2018 for counterpart German Patent Application No. DE 102017217329.7.

* cited by examiner

State of the Art

FUEL SPRAY NOZZLE COMPRISING AXIALLY PROJECTING AIR GUIDING ELEMENT FOR A COMBUSTION CHAMBER OF A GAS TURBINE ENGINE

This application claims priority to German Patent Application No. 102017217329.7 filed Sep. 28, 2017, which application is incorporated by reference herein.

DESCRIPTION

The invention relates to a combustion chamber assembly group with a nozzle for a non-staged combustion chamber of an engine for providing a fuel-air mixture at a nozzle exit opening of the nozzle.

An (injection) nozzle for a combustion chamber of an engine, in particular for an annular combustion chamber of a gas turbine engine, comprises a nozzle main body that comprises the nozzle exit opening and that, in addition to a fuel guiding channel for conveying fuel to the nozzle exit opening, has multiple (at least two) air guiding channels for conveying air that is to be mixed with fuel to the nozzle exit opening. A nozzle usually also serves for swirling the supplied air, which subsequently, intermixed with the supplied fuel, is conveyed into the combustion chamber at the nozzle exit opening of the nozzle. For example, multiple nozzles may be combined into a nozzle assembly group which comprises multiple nozzles that are usually arranged next to each other along a circular line and that serve for introducing fuel into the combustion chamber.

In nozzles with multiple air guiding channels and at least one fuel guiding channel as they are known from the state of the art, for example from U.S. Pat. No. 9,423,137 B2 or 5,737,921 A, it is provided that a first air guiding channel extends along a nozzle longitudinal axis of the nozzle main body and a fuel guiding channel is located radially further outside with respect to the nozzle longitudinal axis as compared to the first air guiding channel. In that case, at least one further air guiding channel is additionally provided to be positioned radially further outside with respect to the nozzle longitudinal axis as compared to the fuel guiding channel. Here, one end of the fuel guiding channel, at which the fuel from the fuel guiding channel flows out in the direction of the air from the first air guiding channel, is typically located—with respect to the nozzle longitudinal axis and in the direction of the nozzle exit opening—in front of the end of the second air guiding channel from which air then flows out in the direction of a mixture of air from the first air guiding channel and fuel from the fuel guiding channel. Further, it is known from the state of the art and for example also provided in U.S. Pat. No. 9,423,137 B2 or 5,737,921 to provide such a nozzle with a third air guiding channel, with its end, which may also be offset radially outwards, succeeding the end of the second air guiding channel in the axial direction.

What is further known from the state of the art is to provide an air guiding element for guiding air that flows from the at least one further air guiding channel at an end of a radially positioned air guiding channel that is located in the area of the nozzle exit opening. Through such an air guiding element, the air that flows out of the further air guiding channel and is usually swirled is deflected radially inward to achieve an intermixing with the fuel from the fuel guiding channel and the additional air, in particular from the first, inner air guiding channel. In this way, a spray cloud with a fuel-air mixture is to be created, with the fuel being present in the form of finely dispersed drops.

Here, in the nozzles that are known from the state oft the art, it has been found that too much fuel may already evaporate in the area of the end of the fuel guiding channel, and thus zones that are strongly enriched with fuel are created, which in turn leads to undesired soot emissions. There is the need for a nozzle as well as combustion chamber assembly group with a nozzle by means of which an improved dispersion and distribution in particular of the liquid fuel can be achieved.

This objective is achieved with a combustion chamber assembly group according to claim 1.

What is accordingly proposed is a nozzle for a non-staged combustion chamber—i.e. for a combustion chamber in which no multiple fuel injection devices succeeding each other in the flow direction are provided—of an engine for providing a fuel-air mixture at a nozzle exit opening of the nozzle that has a nozzle main body that comprises the nozzle exit opening and that extends along a nozzle longitudinal axis, wherein the nozzle main body further at least the following comprises:

- at least one first, inner air guiding channel for conveying air to the nozzle exit opening, extending along the nozzle longitudinal axis,
- at least one fuel guiding channel for conveying fuel to the nozzle exit opening positioned radially further outside with respect to the nozzle longitudinal axis as compared to the first air guiding channel, and
- at least one further air guiding channel positioned radially outside with respect to the nozzle longitudinal axis with regard to the fuel guiding channel, wherein an air guiding element for guiding air flowing from the at least one further air guiding channel is provided at an end of this at least one further air guiding channel located in the area of the nozzle exit opening.

One end of the fuel guiding channel is bordered at the nozzle exit opening by a radially outwardly positioned flow-off edge. With respect to the flow-off edge, the air guiding element projects—with a defined length—in the axial direction with respect to the nozzle longitudinal axis in such a manner, that (a) a reference angle that is present between the nozzle longitudinal axis and a straight boundary line that extends through a (first) point at the flow-off edge and tangentially to the axially projecting air guiding element, and/or (b) a reference angle that is present between the nozzle longitudinal axis and a straight boundary line that extends through a (first) point at the flow-off edge and a (second) point of the air guiding element that extends maximally in the axial direction beyond the flow-off edge is less than or equal to 50°.

Thus, here the flow-off edge of the fuel guiding channel and the axially projecting air guiding element of the radially outwardly located air guiding channel are formed and adjusted to each other for influencing an air flow from the air guiding channel in such a manner that the reference angle(s) are observed according to the previously indicated geometric requirements through an axial projection of the air guiding element. At that, the reference angle according to the above-described variant (a) and the reference angle according to above-described variant (b) can be identical. Thus, a corresponding straight boundary line may for example fulfill both conditions that are indicated under (a) and (b), and thus extend tangentially to the axially projecting air guiding element as well as at the same time extend through a point at the flow-off edge and a point of the air guiding element that projects maximally in the axial direction beyond the flow-off edge.

Through the proposed design of the flow-off edge and of the air guiding element at the end of the nozzle, it can be achieved that, when the nozzle is mounted to the combustion chamber according to the intended use, a maximum outflow angle at which air from the air guiding channel is guided in the direction of the combustion space is less than 50° with respect to the nozzle longitudinal axis. In particular, it can be achieved that this air is guided without conditions to the fuel-air-mixture or the spray of fuel from the fuel guiding channel and air from the first, inner air guiding channel (and possibly a further air guiding channel that is located between the inner air guiding channel and the radially outermost air guiding channel which has the air guiding element at its end). By means of the proposed nozzle design, a maximum outflow angle at which air from the radially outwardly positioned air guiding channel is guided in the direction of the combustion space is less than 50° with respect to the nozzle longitudinal axis. In this way, the fuel better follows the flow path of the air which, in the case of multiple (at least two) radially outwardly positioned air guiding channels, flows out of the radially outermost air guiding channel of the nozzle. Thus, in one embodiment variant, a fuel-air mixture that is created in the central area at the end of the nozzle, where the fuel is already present in the form of drops, easily follows a flow path of the air that flows out of the radially outwardly located air guiding channel, so that the drop-shaped fuel is also guided more strongly radially outwards and is more strongly intermixed with air, which leads to a more even distribution of the fuel and thus to a reduction of soot emissions.

Regarding the flow-off edge, the proposed arrangement and design of the axially projecting air guiding element is in principle independent of a geometry of the air guiding element through which air that is flowing out at the end of the air guiding channel is guided radially inwards. Accordingly, a minimal inner diameter of the nozzle exit opening can still be defined by the air guiding element, so that a taper of the nozzle exit opening (possibly combined with a widening of the nozzle exit opening towards the combustion chamber following downstream) is realized by means of the radially outwardly positioned (circumferentially extending) air guiding element.

A burner seal of the combustion chamber assembly group provided with the nozzle further comprises a bearing section that extends along the nozzle longitudinal axis and has a passage opening inside of which the nozzle is positioned. Here, it is provided that the burner seal has a radially widening flow guiding element in the area of the nozzle exit opening of the nozzle. Thus, here a combustion-space-side end of the [burner seal] is formed with a flow guiding element for guiding the generated fuel-air mixture, wherein this flow guiding element radially widens in the axial direction. An inner shell surface of the radially widening flow guiding element extends at the end of the burner seal at an angle to the nozzle longitudinal axis that substantially corresponds to the reference angle between the nozzle longitudinal axis and the straight boundary line, or is identical to this reference angle. In this way, the axial end points of the air guiding element of the radially outer air guiding channel and the flow guiding element of the burner seal are located on the straight boundary line.

For example, the air guiding element of the nozzle and the flow guiding element of the burner seal extend along this straight boundary line or an outer shell surface of a corresponding straight circular cone. In particular, the air guiding element and the flow guiding element can connect to each other here in a radially outward pointing direction. In this manner, the flow guidance into the combustion space can be supported inside a defined flow cone.

In one embodiment variant, the straight boundary line extends tangentially to the flow-off edge and tangentially to the axially projecting air guiding element. Thus, in the present case, the flow-off edge and the air guiding element of the nozzle are formed and adjusted to each other in such a manner that the reference angle that extends between the nozzle longitudinal axis and a straight boundary line that extends tangentially to the flow-off edge and tangentially to the air guiding element is less than or equal to 50°.

In a further development based hereon, in which the air guiding element has a radially inward pointing bulge, the straight boundary line can further extend through a point at the air guiding element which is located behind the radially inward pointing bulge of the air guiding element in the axial direction. Through the radially inward pointing, typically convex bulge of the air guiding element, air that is flowing out of the radially outwardly positioned guiding channel and that is possibly swirled is guided radially inward, so that an air flow from the air guiding channel has a radially inward pointing direction component. In that case, the flow-off edge of the fuel guiding channel and the air guiding element are geometrically designed with respect to each other and/or arranged with respect to each other in such a manner that the reference angle between the nozzle longitudinal axis and the straight boundary line is less than or equal to 50°, wherein then the straight boundary line that extends tangentially to the flow-off edge and tangentially to the air guiding element extends through a (reference) point at the air guiding element that is located behind or downstream of the inward pointing bulge of the guiding element.

Within the context of the proposed solution, it has for example proven to be particularly advantageous if the flow-off edge of the fuel guiding channel and the air guiding element abut at an outer shell surface of a virtual straight circular cone, with its cone point being located on the—centrally extending—nozzle longitudinal axis and its opening angle corresponding to twice the reference angle. The flow-off edge and the air guiding element of the radially outwardly located air guiding channel are thus formed and adjusted to each other in such a manner that an axial end of the flow-off edge and the air guiding element that axially projects beyond the end of the flow-off edge touch an outer shell surface of such a virtual straight circular cone (in individual points). Accordingly, here the flow-off edge and the air guiding element are formed and arranged with respect to each other in such a manner that in particular the length with which an end of the air guiding element projects in the axial direction (pointing to the combustion space in the mounted state) with respect to the flow-off edge of the fuel guiding channel is predefined at the nozzle exit through a straight circular cone with an opening angle that corresponds to twice the predefined reference angle, with its cone point being located on the (centrally extending) nozzle longitudinal axis.

In principle, the nozzle can have at least two further air guiding channels that are radially offset with respect to each other in addition to the first, inner air guiding channel. Here, the guide channel with the axially projecting air guiding element, with its axial length and design being predefined with respect to the flow-off edge of the fuel guiding channel, forms the radially outermost air guiding channel. The air guiding element thus defines the radially outermost border of the nozzle exit opening and in particular defines the axial course of the inner diameter of the nozzle exit opening at its combustion-space-side end.

Alternatively or additionally, the burner seal can form an end in the area of the nozzle exit opening of the nozzle that is substantially flush or is flush with a heat shield of the combustion chamber assembly group. This in particular includes that an end of the burner seal is substantially flush or is flush with an edge section of the heat shield bordering an opening in the heat shield inside of which the burner seal is supported. The contour of the heat shield in the area of the edge section thus connects to the burner seal and allows an even transition from the burner seal to the heat shield in a radially outwardly pointing direction. An at least substantially flush connection of the burner seal to the heat shield further allows minimizing a radial gap between the burner seal and the heat shield, whereby the entry of combustion products between the burner seal and the heat shield is avoided.

Furthermore, if necessary, the heat shield can be chamfered at the edge section of the opening through which the burner seal is projecting to facilitate a smooth or an even smoother transition to a flow guiding element of the burner seal that widens radially outwards in the axial direction. In this manner, it is for example achieved that in the event of a maximum axial displacement of the burner seal with respect the heat shield as it occurs during operation of the engine, a radial distance between the burner seal and the heat shield is maintained below a predefined threshold value, which may for example be less than or equal to 0.2 mm.

Alternatively or additionally, in one embodiment variant a combustion chamber assembly group can be provided, in which the burner seal forms an end in the area of the nozzle exit opening of the nozzle which projects beyond a heat shield of the combustion chamber assembly group in the axial direction by a length a, with $a \leq 1.5$ d applying with respect to a wall thickness d of the projecting end.

As a part of the proposed solution, what is further proposed is an engine with at least combustion chamber assembly group according to the invention.

The attached Figures illustrate possible embodiment variants of the proposed solution by way of example.

Herein:

Figure 7A:
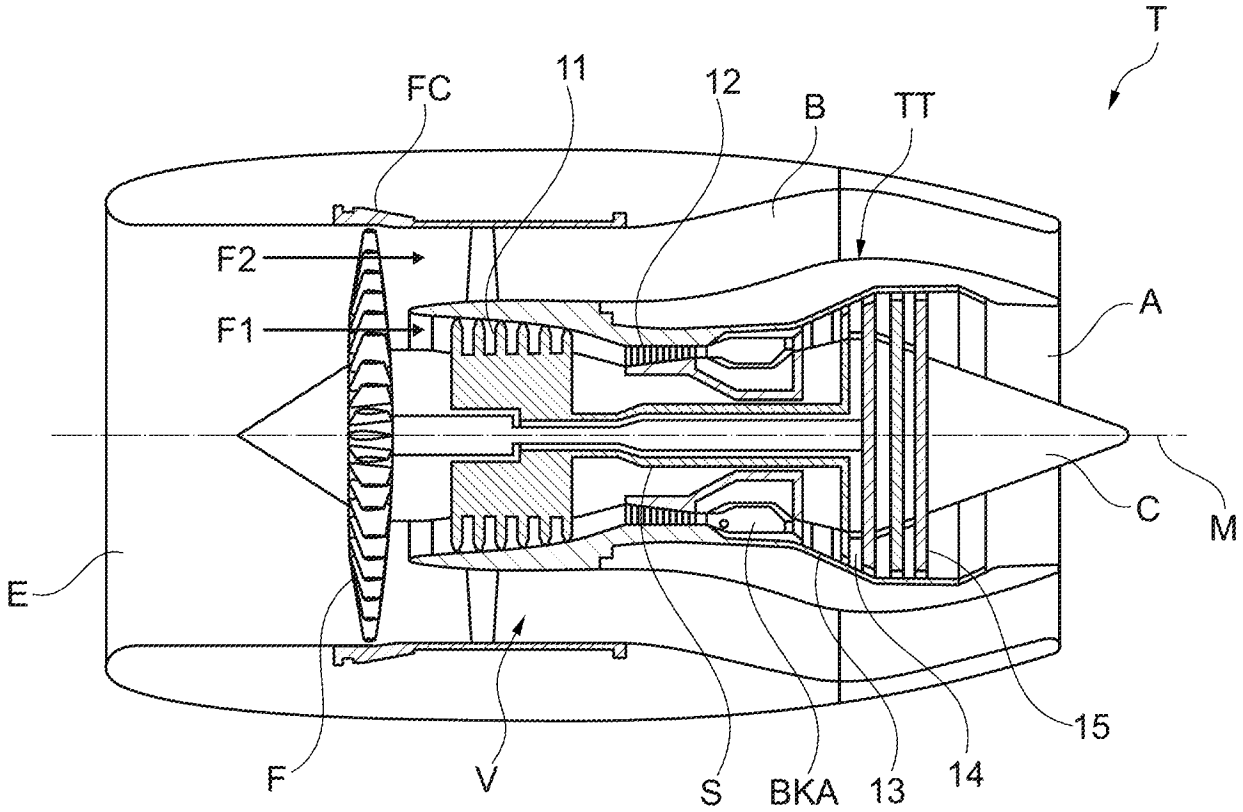
FIG. 7A shows an engine in which the embodiment variants of FIGS. 1 to 6 are used.

FIG. 7A schematically illustrates, in a sectional view, a (turbofan) engine T in which the individual engine components are arranged in succession along a rotational axis or central axis M and the engine T is embodied as a turbofan engine. By means of a fan F, air is suctioned in along an entry direction at an inlet or an intake E of the engine T. This fan F, which is arranged inside a fan housing FC, is driven via a rotor shaft S that is set into rotation by a turbine TT of the engine T. Here, the turbine TT connects to a compressor V, which for example has a low-pressure compressor 11 and a high-pressure compressor 12, and where necessary also a medium-pressure compressor. The fan F supplies air to the compressor V in a primary air flow F1, on the one hand, and, on the other, to a secondary flow channel or bypass channel B in a secondary air flow F2 for creating a thrust. Here, the bypass channel B extends about a core engine that comprises the compressor V and the turbine TT, and also comprises a primary flow channel for the air that is supplied to the core engine by the fan F.

The air that is conveyed via the compressor V into the primary flow channel is transported into the combustion chamber section BKA of the core engine where the driving power for driving the turbine TT is generated. For this purpose, the turbine TT has a high-pressure turbine 13, a medium-pressure turbine 14, and a low-pressure turbine 15. The turbine TT drives the rotor shaft S and thus the fan F by means of the energy that is released during combustion in order to generate the necessary thrust by means of the air that is conveyed into the bypass channel B. The air from the bypass channel B as well as the exhaust gases from the primary flow channel of the core engine are discharged via an outlet A at the end of the engine T. Here, the outlet A usually has a thrust nozzle with a centrally arranged outlet cone C.

Figure 7B:
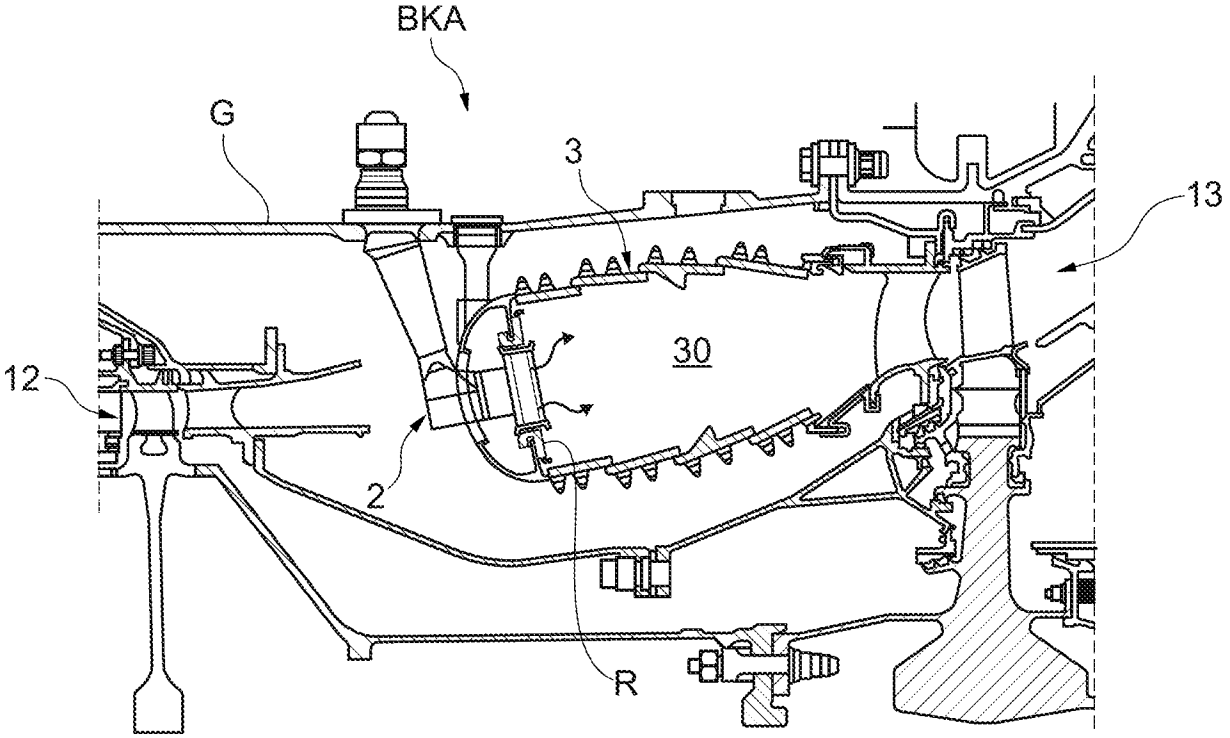
FIG. 7B shows, in sections and on an enlarged scale, the combustion chamber of the engine of FIG. 7A.

FIG. 7B shows a longitudinal section through the combustion chamber section BKA of the engine T. Here, in particular an (annular) combustion chamber 3 of the engine T can be seen. A nozzle assembly group is provided for injecting fuel or an air-fuel-mixture into a combustion space 30 of the combustion chamber 3. It comprises a combustion chamber ring R along which multiple (fuel/injection) nozzles 2 are arranged along a circular line about the central axis M. Here, the nozzle exit openings of the respective nozzles 2 that are positioned inside the combustion chamber 3 are provided at the combustion chamber ring R. Here, each nozzle 2 comprises a flange by means of which a nozzle 2 is screwed to an outer housing G of the combustion chamber section 3.

Figure 7C:
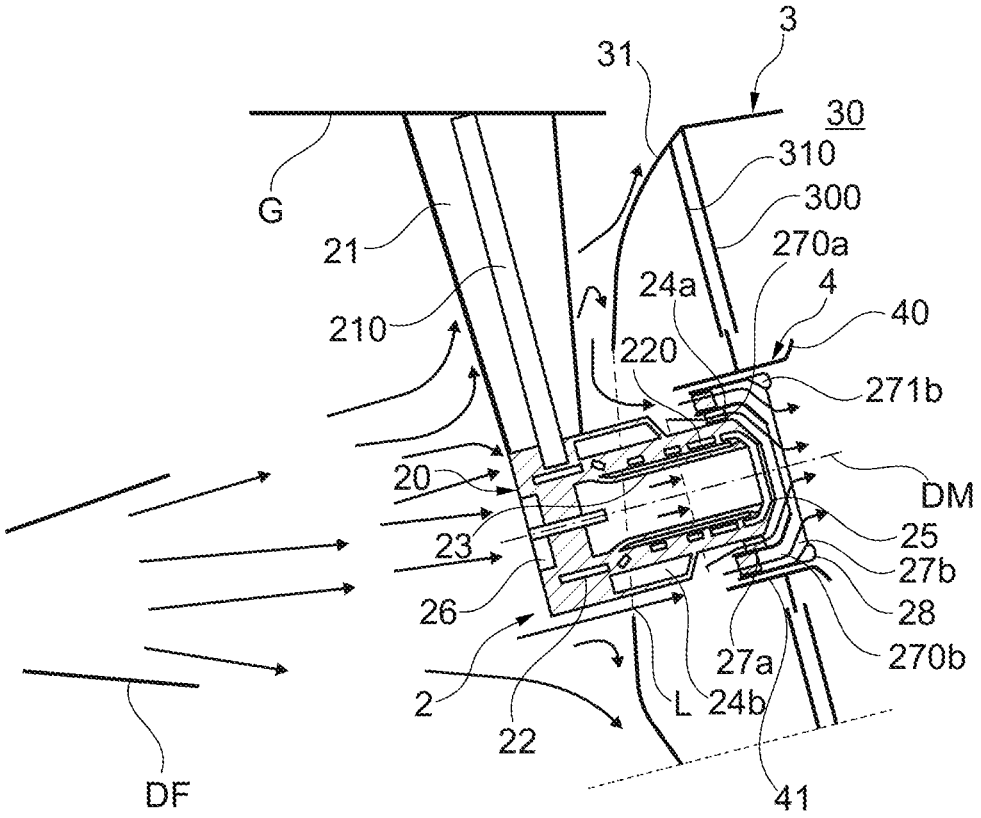
FIG. 7C shows, in a cross-sectional view, the basic structure of a nozzle according to the state of the art and the surrounding components of the engine in the installed state of the nozzle.

FIG. 7C now shows a cross-sectional view of the basic structure of a nozzle 2 as well as the surrounding components of the engine T in the installed state of the nozzle 2. Here, the nozzle 2 is part of a combustion chamber system of the engine T. The nozzle 2 is located downstream of a diffuser DF and during mounting is inserted through an access hole L through a combustion chamber head 31, through a heat shield 300 and a head plate 310 of the combustion chamber 3 up to the combustion space 30 of the combustion chamber 3, so that a nozzle exit opening formed at a nozzle main body 20 reaches all the way into the combustion space 30. Here, the nozzle 2 is positioned at the combustion chamber 3 via a longitudinal section 41 of the burner seal 4 and is held inside a passage hole of the longitudinal section 41. The nozzle 2 further comprises a nozzle neck 21 which substantially extends radially with respect to the central axis M and inside of which a fuel supply line 210 conveying fuel to the nozzle main body 20 is accommodated. Further formed at the nozzle main body 20 are a fuel chamber 22, fuel passages 220, heat shields 23 as well as air chambers for insulation 23*a* and 23*b*. In addition, the nozzle main body 20 forms a (first) inner air guiding channel 26 extending centrally along a nozzle longitudinal axis DM and, positioned radially further outside with respect to the same, a (second and third) outer air guiding channels 27*a* and 27*b*. These air guiding channels 26, 27*a* and 27*b* extend in the direction of the nozzle exit opening of the nozzle 2.

Further, also at least one fuel guiding channel 26 is formed at the nozzle main body 20. This fuel guiding channel 25 is located between the first inner air guiding channel 26 and the second outer air guiding channel 27*a*. The end of the fuel guiding channel 25, via which fuel flows out in the direction of the air from the first inner air guiding channel 26 during operation of the nozzle 2, is located—with respect to the nozzle longitudinal axis DM and in the direction of the nozzle exit opening—in front of an end of the second air guiding channel 27*a* from which air from the second, outer air guiding channel 27*a* flows out in the direction of a mixture of air from the first, inner air guiding channel 26 and fuel from the fuel guiding channel 25.

Figure 7D:
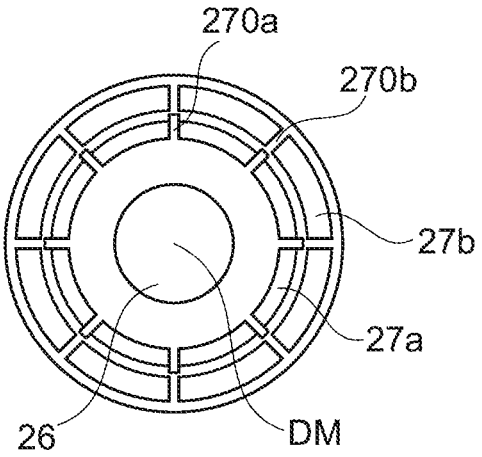
FIG. 7D shows a back view of a nozzle exit opening, also showing swirling elements that are provided in the radially outwardly located air guiding channels of the nozzle.

Swirling elements 270*a*, 270*b* for swirling the air supplied through the air guiding channels 27*a* and 27*b* are provided in the outer air guiding channels 27*a* and 27*b*. Further, the nozzle main body 20 also comprises an outer, radially inwardly oriented air guide element 271*b* at the end of the third outer air guiding channel 27*b*. In the nozzle 2, which may e.g. be a pressure-assisted injection nozzle, the ends of the second and third radially outwardly located air guiding channels 27*a* and 27*b* follow—with respect to the nozzle longitudinal axis DM and in the direction of the nozzle exit opening—the end of the fuel guiding channel 25 from which fuel is supplied to the air from the first inner centrally extending air guiding channel 26 during operation of the engine T, according to FIG. 7C. Air that is swirled by means of the swirling elements 270*a*, 270*b* is transported to the nozzle exit opening form these second and third air guiding channels 27*a* and 27*b*. As is shown in the back view of FIG. 7D with a view of the nozzle exit opening along the nozzle longitudinal axis DM, these swirling elements 270*a*, 270*b* are arranged inside the respective air guiding channel 27*a*, 27*b* in a circumferentially distributed manner.

A sealing element 28 is also provided at the nozzle main body 20 at its circumference for sealing the nozzle 2 towards the combustion space 30. This sealing element 28 forms a counter-piece to a burner seal 4. This burner seal 4 is floatingly mounted between the heat shield 300 and the head plate 310 to compensate for radial and axial movements between the nozzle 2 and the combustion chamber 3 and to ensure reliable sealing in different operational states.

The burner seal 4 usually has a flow guiding element 40 towards the combustion space 30. In connection with the third outer air guiding channel 27*b* at the nozzle 2, this flow guiding element 40 ensures a desired flow guidance of the fuel-air mixture that results from the nozzle 2, more precisely the swirled air from the air guiding channels 26, 27*a* and 27*b*, as well as the fuel guiding channel 25.

A combustion chamber assembly group corresponding to FIG. 7C as it is known from the state of the art can be disadvantageous with respect to the generation of soot emissions. Thus, air flow from the third air guiding channel 27*b* that is guided radially inwardly via the air guiding element 271*b* may possibly fail to lead to a desired homogenous distribution of the fuel directly downstream of the nozzle exit opening. Areas with too much excessive fuel can be created in particular in the area directly downstream of the fuel guiding channel 25, which in turn lead to the generation of soot emissions. This can be remedied by the proposed solution, of which different embodiment variants are shown in FIG. 1A to 6.

Here, it is respectively provided that a flow-off edge 250 that borders the end of the fuel guiding channel 25 radially outside at the nozzle exit opening, and the air guiding element 271*b* that projects with respect to this flow-off edge 250 in the axial direction x along the nozzle longitudinal axis DM are formed and adjusted with respect to each other in such a manner for influencing an air flow LS from the third air guiding channel 271*b*, that a reference angle $\alpha$ which is present between the nozzle longitudinal axis DM and a straight boundary line 6 is less than or equal to 50°. This straight boundary line 6 extends through a (first) point at the flow-off edge 250 (e.g. through a point at a flow-off edge of the flow-off edge 250) and tangentially to the axially projecting air guiding element 271*b*, in particular tangentially to the flow-off edge 250 and tangentially to the air guiding element 271*b* that initially guides the air flow LS radially inward. Alternatively or additionally, the straight boundary line 6 extends through a point at the flow-off edge 250 and a (reference) point 2712*b* of a combustion-space-side end of the air guiding element 271*b* that projects maximally beyond the flow-off edge 250 in the axial direction x.

Figure 1A:
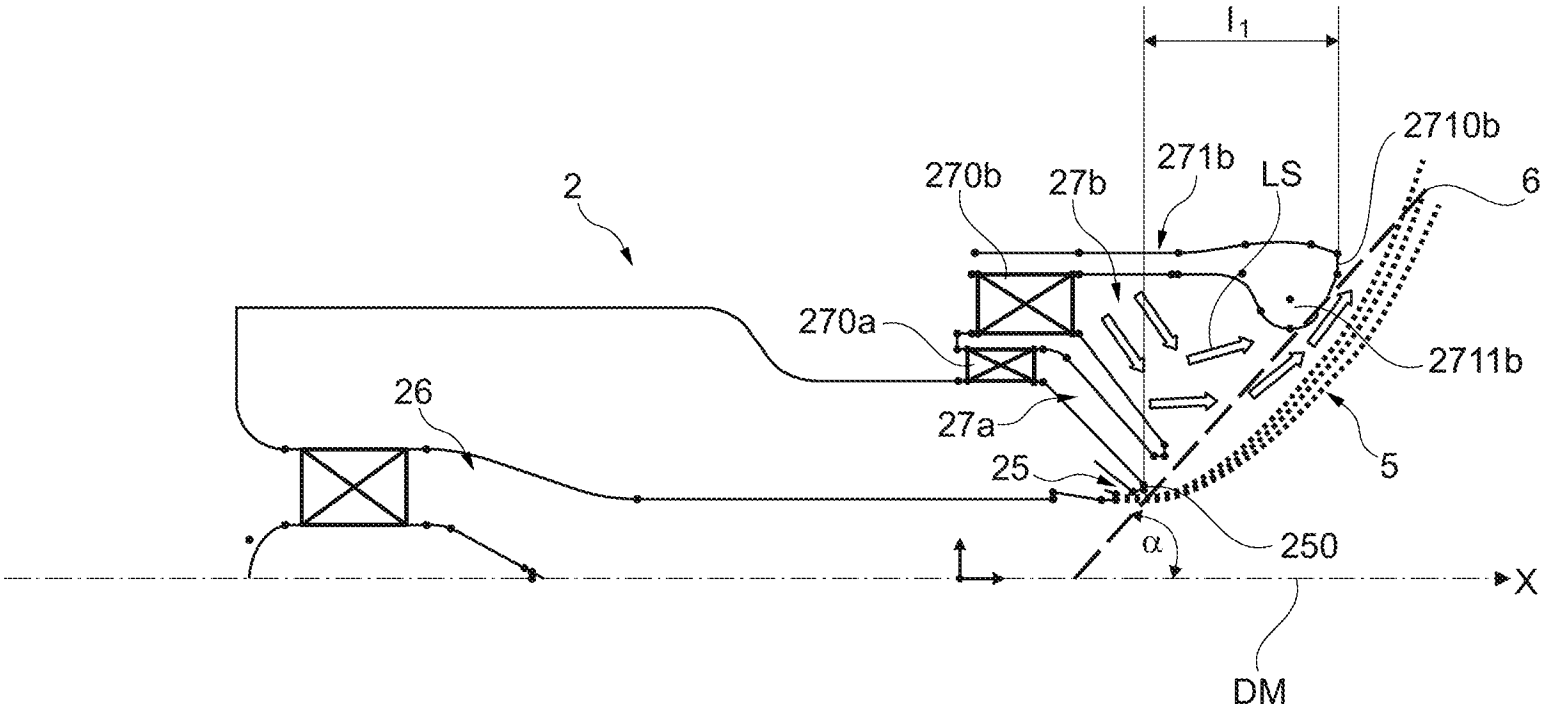
FIG. 1A shows, in sections, a first embodiment variant of a nozzle according to the invention in which a flow guidance inside the predefined flow cone is achieved by means of an air guiding element of a radially outermost air guiding channel that projects axially with a defined length.

For example, in the nozzle 2 shown in FIG. 1A, the air guiding element 271*b* projects beyond the flow-off edge 250 of the fuel guiding channel 25 in the axial direction x with a predefined length so that the straight boundary line 6, as a tangent at the flow-off edge 250 and a radially inwardly pointing bulge 2711*b* of the air guiding element 271*b*, encloses an angle $\alpha \leq 50°$ with respect to the centrally extending nozzle longitudinal axis DM. The air flow LS coming from the third air guiding channel 27*b* is thus guided at an inner contour 2710*b* of the axially projecting air guiding element 271*b* in the radially outwards pointing direction inside a spray cone 5, which is approximated to a naturally resulting spray cone of the injected fuel from the fuel guiding channel 25 and thus to the created fuel-air-mixture. The air flow LS from the third air guiding channel 27*b* is thus guided at the nozzle exit opening into a virtual straight circular cone by means of the air guiding element 271*b* that is thus arranged with respect to the flow-off edge 250 of the fuel guiding channel 25, with its cone point being located on the nozzle longitudinal axis DM and with its opening angle being $2\alpha$. Thus, in FIG. 1 the straight boundary line 6 indicates the course of an outer shell surface of this straight circular cone at which the flow-off edge 250 and the air guiding element 271*b* (in the area of its bulge 2711*b*) abut.

Through the design of the nozzle 2 thus chosen, a flow path with a flow-off angle of 50° is imposed on the air flow LS, so that the air from the third air guiding channel 27*b* is guided without conditions to the radially outwardly flowing spray which results from the fuel from the fuel guiding channel 25 and the swirled air from the first, inner air guiding channel 26 and the second air guiding channel 27*a*.

Figure 1B:
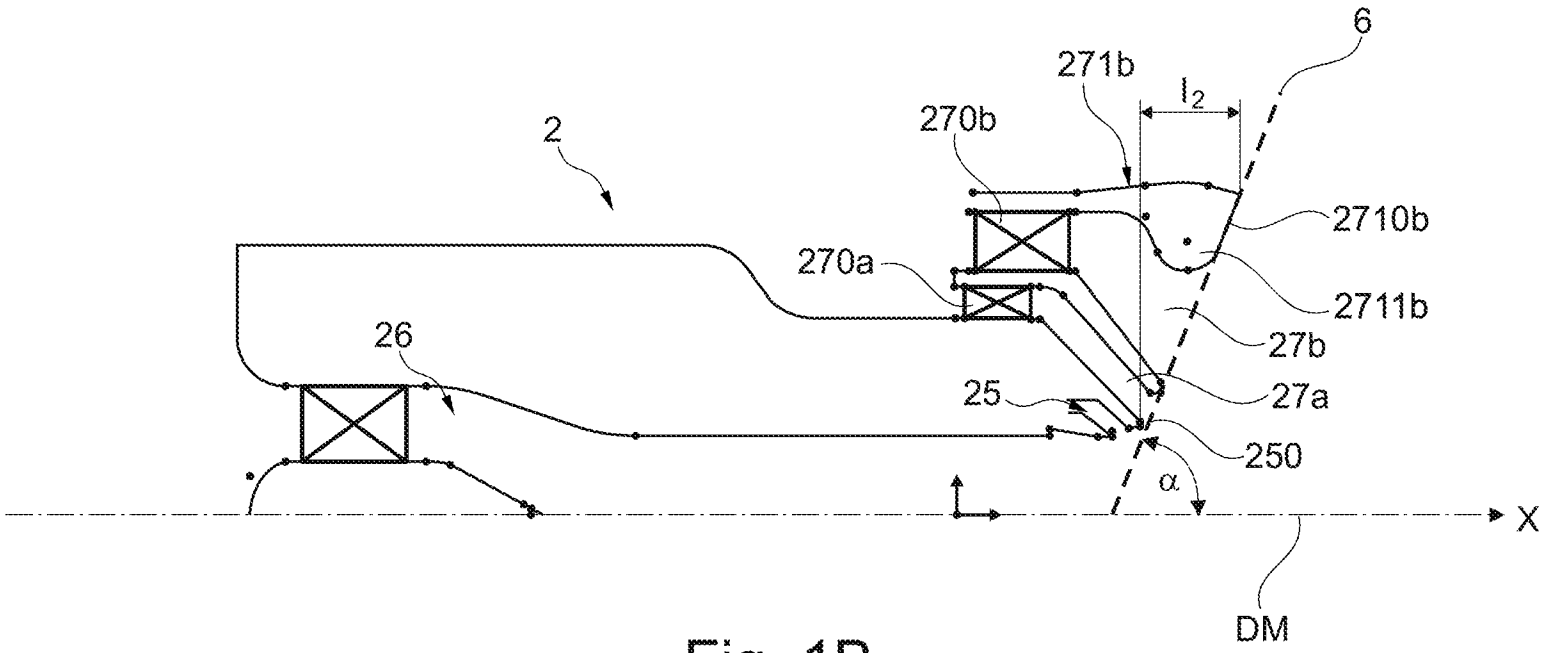
FIG. 1B shows, in a view corresponding to FIG. 1A, an alternative embodiment variant of the nozzle.

In the embodiment variant of FIG. 1B, the axial projection of the air guiding element 271*b* is reduced as compared to the embodiment variant of FIG. 1A. Here, the air guiding element 271*b* projects with its convex inward pointing bulge 2711*b* with a smaller length $l_2$ with respect to the flow-off edge 250 of the fuel guiding channel 25 ($l_2 \leq l_1$). However, also here, the length and geometry of the flow-off edge 250 and of the air guiding element 271*b* of the third air guiding channel 27*b* are chosen and adjusted to each other in such a manner for influencing the air flow LS in a targeted manner that, together with the nozzle longitudinal axis DM, the straight boundary line 6, as a tangent at the flow-off edge 250 and the bulge 2711*b* of the air guiding element 271*b*, encloses an angle $\alpha \leq 50°$. The straight boundary line 6 thus also runs through a point at the flow-off edge 250 (of a so-called "pre-filmer") and a point that is located on a tangent at the inner contour 2710*b* of the air guiding element 271*b* that is facing towards the combustion space 30.

Figure 2:
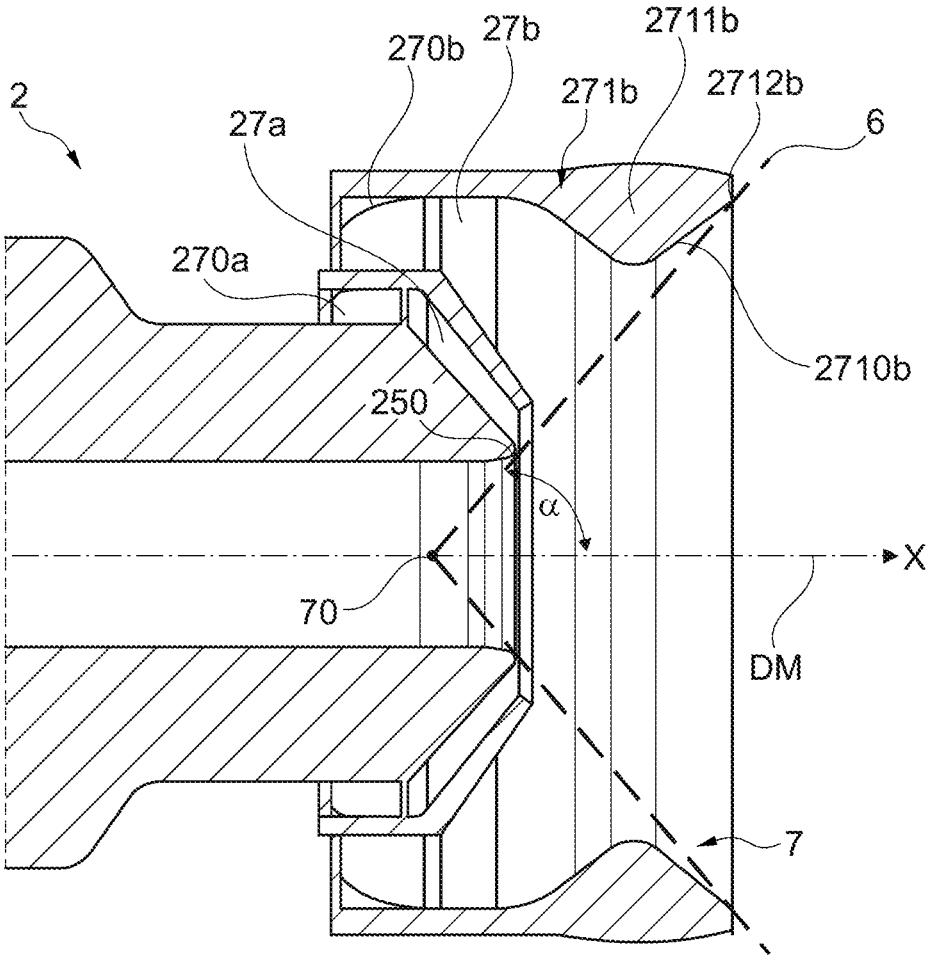
FIG. 2 shows, in a cross-sectional view, a further embodiment variant of a nozzle according to the invention.
Figure 3A:
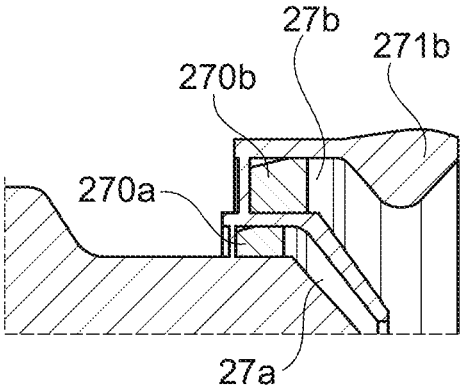
FIGS. 3A-3F shows, in identical views and respectively in sections, alternative embodiments of the air guiding element.
Figure 3B:
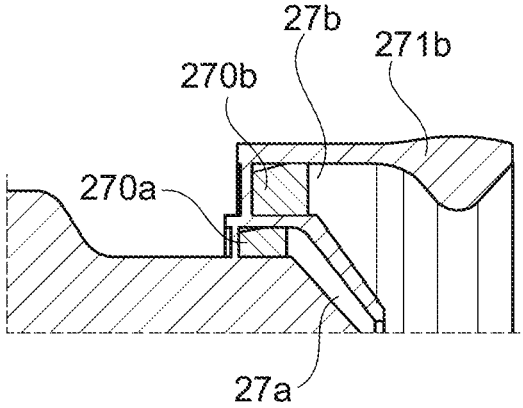
Figure 3C:
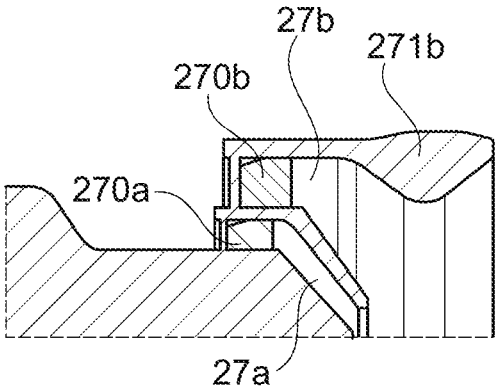
Figure 3D:
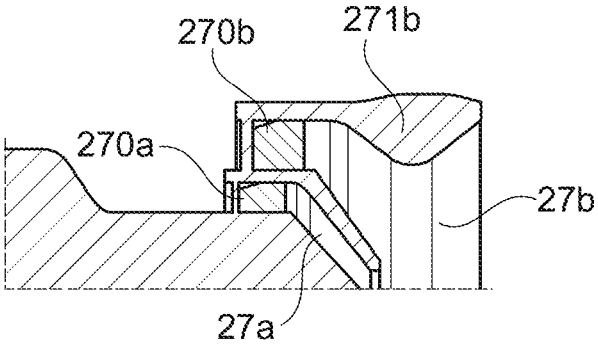
Figure 3E:
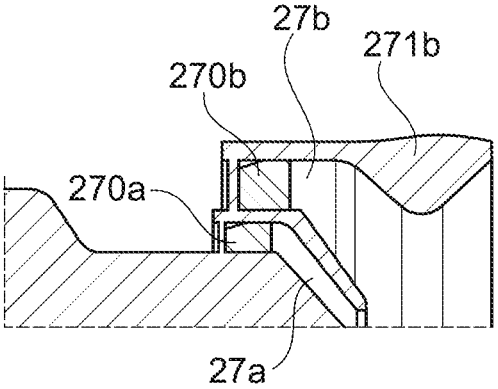
Figure 3F:
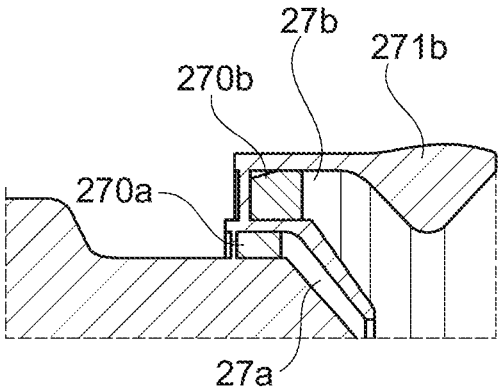

In the variant of FIG. 2, the straight boundary line 6 also extends tangentially and thus through a point at the flow-off edge 250 of the fuel guiding channel 25. However, at the air guiding element 271*b*, the straight boundary line 6 extends through an axially outermost reference point 2712*b*. Here too, the geometry and the arrangement of the air guiding element 271*b* are chosen in such a manner with regard to the flow-off edge 250 of the fuel guiding channel 25 that, in order to influence the air flow LS from the third air guiding channel 27*b*, the flow-off edge 250 and the inner contour 2710*b* abut at an outer shell surface of a virtual reference or circular cone 7 downstream of the (inner) bulge 2711*b*, with the cone point 70 of the circular cone 7 being located on the nozzle longitudinal axis DM and having an opening angle of $2\alpha$, with $\alpha \leq 50°$.

FIGS. 3A to 3F illustrate different geometries of the air guiding element 271*b* in particular with respect to a course of an inner contour 2710*b* that is defined by means of the radially inward pointing bulge 2711*b* and the axial length of the air guiding element 271*b*.

Figure 4:
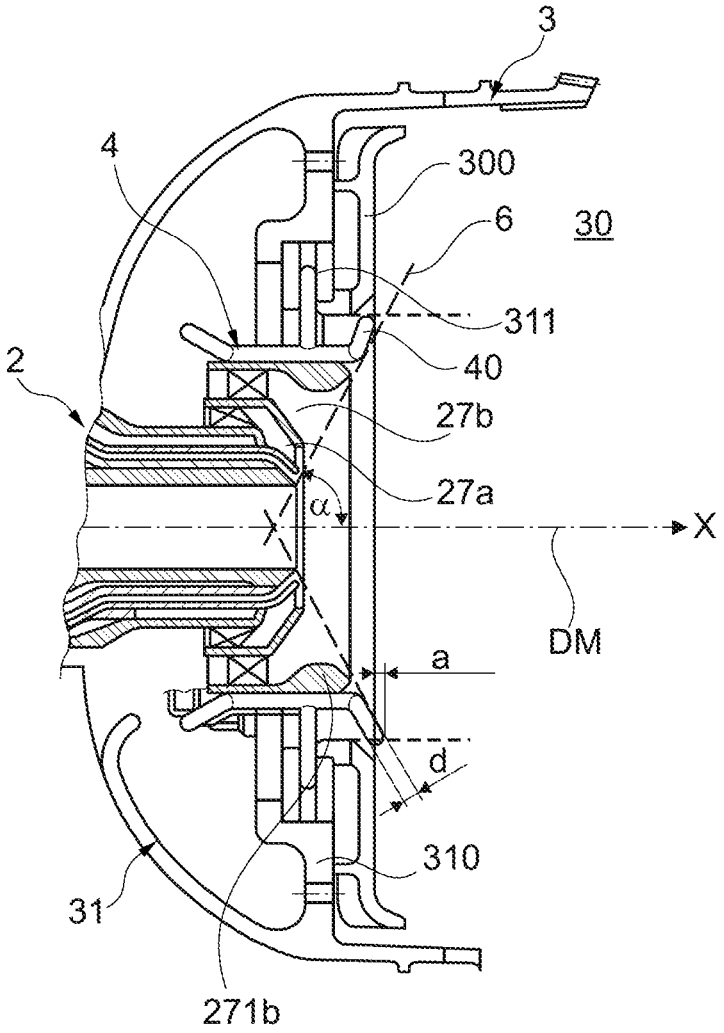
FIG. 4 shows, in a cross-sectional view and in sections, a combustion chamber assembly group with a burner seal that has a flow guiding element which is substantially flush with a heat shield and connects to the air guiding element of the nozzle along a straight boundary line in the radially outwards pointing direction.

In the combustion chamber assembly group shown in FIG. 4, in which a nozzle 2 according to the previously described FIGS. 1A to 3F is used, the burner seal 4 is designed to be substantially flush with the heat shield 300 with its combustion-space-side flow guiding element 40. Thus, the radially widening flow guiding element 40 projects beyond the heat shield 300 or rather beyond an edge section of the heat shield 300 that is bordering the opening for the burner seal 4 only with a length a, which is less than 1.5 times a wall thickness d of the flow guiding element 40.

For an optimized guiding of the fuel-air mixture, an inner shell surface of the flow guiding element 40 of the [burner seal] 4 further extends at the same reference angle $\alpha$ to the nozzle longitudinal axis DM and thus connects to the air guiding element 271*b* in the radially outwards pointing direction along the straight boundary line 6.

Moreover, in the present case the burner seal 4 that is floatingly mounted at the bearing position 311 is provided with a close fit between the flow guiding element 40 and the heat shield 300, so that, in the event of a maximal axial displacement of the burner seal 4 as it occurs during operation of the engine T, a radial distance between the burner seal 4 and the heat shield 300 does not exceed a predefined threshold value of 0.2 mm. Besides, a close fit between the burner seal 4 and the heat shield 300 in the area of the end of the flow guiding element 40 avoids the entry of combustion products into a cavity between the burner seal 4 and the heat shield 300.

Figure 5:
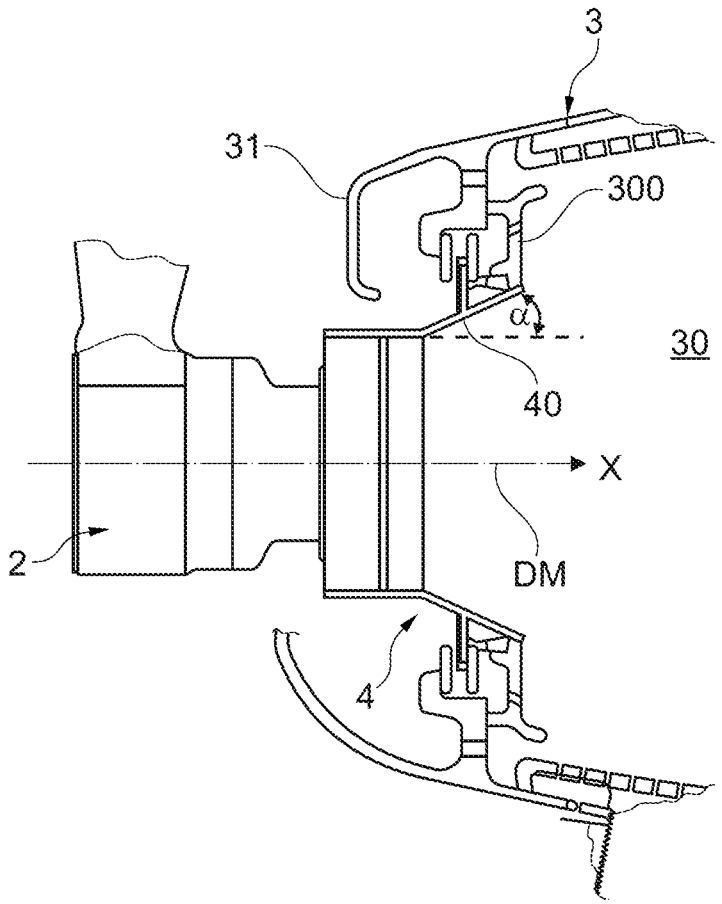
FIG. 5 shows, in sections and in a cross-sectional view, a further development of the embodiment variant of FIG. 4 with a burner seal with a widening flow guiding element of greater length.

In the variant shown in FIG. 5, the continuously widening flow guiding element 41 is formed with an inner shell surface that is less inclined as compared to the variant of FIG. 4. However, here it is also provided that the flow guiding element 40 is substantially flush or is flush with a burner seal 300, and that the inner shell surface of the flow guiding element 40 extends at a reference angle $\alpha$ to the nozzle longitudinal axis DM.

Figure 6:
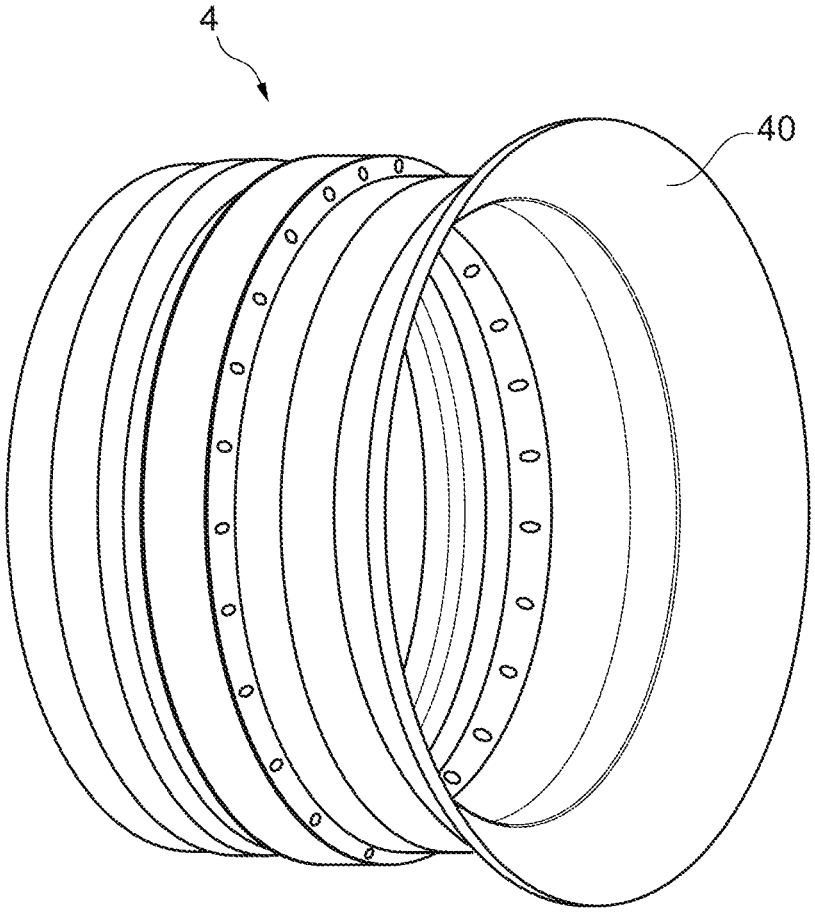
FIG. 6 shows, in a perspective view, a burner seal for an embodiment variant according to FIG. 5.

FIG. 6 illustrates a perspective view of a possible design of the burner seal that is shown schematically in FIG. 5, including the flow guiding element 40 that widens towards the combustion space 30.

PARTS LIST

11 low-pressure compressor
12 high-pressure compressor
13 high-pressure turbine
14 medium-pressure turbine
15 low-pressure turbine
2 nozzle
20 nozzle main body
21 neck
210 fuel supply line
22 fuel chamber
220 fuel passage
23 heat shield
24*a*, 24*b* air chamber
25 fuel guiding channel
250 flow-off edge
26 first air guiding channel
270*a*, 270*b* swirling element
271*b* air guiding element
2710*b* inner contour
2711*b* bulge
2712*b* reference point
27*a* second air guiding channel
27*b* third air guiding channel
3 sealing element
30 combustion chamber
300 combustion space
300 heat shield
31 combustion chamber head
310 head plate
311 bearing position
4 burner seal
40 flow guiding element
41 longitudinal section
5 spray cone
6 tangent/straight boundary line
7 reference cone/circular cone
70 cone point
A outlet
a length
B bypass channel
BKA combustion chamber section
C outlet cone
D wall thickness
DF diffuser
DM nozzle longitudinal axis
E inlet/intake
F fan
F1, F2 fluid flow
FC fan housing
G outer housing
L access hole
$l_1$, $l_2$ length
LS air flow
M central axis/rotational axis
R combustion chamber ring S rotor shaft
T (turbofan) engine
TT turbine
V compressor
x direction
α reference angle

The invention claimed is:

1. A combustion chamber assembly group, comprising:

a burner seal that comprises a bearing section that extends along a nozzle longitudinal axis and has a passage opening, and a nozzle for a non-staged combustion chamber of an engine that is positioned inside a passage hole of the bearing section for providing a fuel-air mixture at a nozzle exit opening of the nozzle, wherein the nozzle has a nozzle main body that comprises the nozzle exit opening and that extends along the nozzle longitudinal axis, and the nozzle main body further comprises at least the following:

an inner first air guiding channel that extends along the nozzle longitudinal axis for conveying air to the nozzle exit opening, a fuel guiding channel for conveying fuel to the nozzle exit opening, which is located radially further outside with respect to the nozzle longitudinal axis as compared to the inner first air guiding channel, and at least one further air guiding channel that is located radially outside with respect to the nozzle longitudinal axis with regard to the fuel guiding channel, wherein an air guiding element for guiding air flowing from the at least one further air guiding channel is provided at an end of the at least one further air guiding channel located in an area of the nozzle exit opening wherein:

one end of the fuel guiding channel at the nozzle exit opening is bordered by a flow-off edge that is located radially outside of the fuel guiding channel and the air guiding element projects into an axial direction with respect to the nozzle longitudinal axis, such that at least one chosen from the following applies:

a first reference angle that is present between the nozzle longitudinal axis and a first straight boundary line extending through a point at the flow-off edge and tangentially to the axially projecting air guiding element is less than or equal to 50°, and a second reference angle that is present between the nozzle longitudinal axis and a second straight boundary line extending through the point at the flow-off edge and a point of the air guiding element that projects maximally beyond the flow-off edge in the axial direction is less than or equal to 50°, wherein the burner seal has a radially widening flow guiding element in the area of the nozzle exit opening and an inner shell surface of the radially widening flow guiding element extends at an end of the burner seal at an angle to the nozzle longitudinal axis that substantially corresponds to, or is identical to, the at least one chosen from the first reference angle and the second reference angle.

2. The combustion chamber assembly group according to claim 1, wherein at least one chosen from the first straight boundary line and the second straight boundary line extends tangentially to the flow-off edge and tangentially to the air guiding element.

3. The combustion chamber assembly group according to claim 2, wherein the air guiding element has a radially inward pointing bulge and the at least one chosen from the first straight boundary line and the second straight boundary line extends through a point at the air guiding element that is located behind the radially inward pointing bulge of the air guiding element in the axial direction.

4. The combustion chamber assembly group according to claim 1, wherein the flow-off edge and the air guiding element abut at an outer shell surface of a virtual straight circular cone, with a cone point being located on the nozzle longitudinal axis and with an opening angle of the cone corresponding to twice the at least one chosen from the first reference angle and the second reference angle.

5. The combustion chamber assembly group according to claim 1, wherein the at least one further air guiding channel includes two further air guiding channels that are radially displaced with respect to each other, wherein one of the two further air guiding channels that is provided with the air guiding element forms a radially outermost one of the two further air guiding channels.

6. The combustion chamber assembly group according to claim 1, wherein, in the area of the nozzle exit opening, the burner seal forms an end that is substantially flush or is flush with a heat shield of the combustion chamber assembly group.

7. The combustion chamber assembly group according to claim claim 6, wherein, in the area of the nozzle exit opening, the burner seal forms an end that projects beyond the heat shield of the combustion chamber assembly group in the axial direction by a length a, for which the following applies with regard to a wall thickness d of the projecting end: $a \leq 1.5\ d$.

8. An engine with the combustion chamber assembly group according to claim 1.

* * * * *